United States Patent [19]

Porter

[11] Patent Number: 4,464,994

[45] Date of Patent: Aug. 14, 1984

[54] APPARATUS FOR PLUGGING A BLAST HOLE IN AN IN SITU OIL SHALE RETORT OR THE LIKE

[75] Inventor: Darrell D. Porter, Englewood, Colo.

[73] Assignees: Standard Oil Company (Indiana); Gulf Oil Corporation, both of Chicago, Ill.

[21] Appl. No.: 393,719

[22] Filed: Jun. 30, 1982

[51] Int. Cl.[3] ..... F42D 7/00

[52] U.S. Cl. ..... 102/333; 102/312; 102/313; 102/319; 405/286; 166/285; 166/292

[58] Field of Search ..... 102/304, 312, 313, 319, 102/333; 166/285, 286, 290, 292; 405/285, 286

[56] References Cited

U.S. PATENT DOCUMENTS

| | | | |
|---|---|---|---|
| 2,047,774 | 7/1936 | Greene | 102/313 X |
| 2,216,067 | 9/1940 | Clark | 166/286 X |
| 2,672,200 | 3/1954 | Patterson | 102/319 X |
| 3,208,521 | 9/1965 | Holland et al. | 166/286 |
| 3,578,083 | 5/1971 | Anderson et al. | 166/285 |
| 3,640,585 | 2/1972 | Hamilton et al. | 86/20 C X |
| 3,724,550 | 4/1973 | Lanmon | 166/285 |
| 3,872,925 | 3/1975 | Owen et al. | 166/286 |
| 4,165,690 | 8/1979 | Abrahams | 86/20 C X |

FOREIGN PATENT DOCUMENTS

| | | | |
|---|---|---|---|
| 1011964 | 7/1952 | France | 102/319 |

*Primary Examiner*—Peter A. Nelson

*Attorney, Agent, or Firm*—Thomas W. Tolpin; William T. McClain; William H. Magidson

[57] ABSTRACT

A plugging apparatus is provided to reliably plug a bottomless blast hole in underground oil shale retorts and oil and gas wells. The plugging apparatus has a special electrically powered sequencer which automatically lowers and releases a bag of cementatious slurry, supported by a drainpipe-reinforced concrete disc, from a canister to form a composite blasting plug in the blast hole.

18 Claims, 13 Drawing Figures

25
20
36
21
27
22
34
44
28
30
42
40
26
32
46
38

25
21
20
27
22
36
44
26
42
28
30
40
32
46
38

21
22
36
34
30
40
23
32
46
38

7.
9.
48
50
52
54
56
58
60
62
64
66
68
70
72
74
78
80
82
84
86
88
90
92
94
96
98
102
104
105
106
108
110
112
114
116
118
122
124
126
128
130
132
134
136
138
140
142
144
146
148
150
152
154
156
158
160
162
164
168
170
172
174
176
178
25

APPARATUS FOR PLUGGING A BLAST HOLE IN AN IN SITU OIL SHALE RETORT OR THE LIKE

BACKGROUND OF THE INVENTION

This invention relates to an apparatus for plugging a blast hole for rubblizing underground oil shale retorts, and blasting oil and gas wells.

Researchers have now renewed their efforts to find alternative sources of energy and hydrocarbons in view of recent rapid increases in the price of crude oil and natural gas. Much research has been focused on recovering hydrocarbons from solid hyrdocarbon-containing material, such as oil shale, coal, and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases, and residual carbon. It has been estimated that an equivalent of 7 trillion barrels of oil is contained in oil shale deposits in the United States with almost 60 percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine grained sedimentary rock stratified in horizontal layers with variable richness of kerogen content. Kerogen has limited solubility in ordinary solvents and, therefore, cannot be recovered by extraction. Upon heating oil shale to a sufficient temperature, the kerogen is thermally decomposed to liberate vapors, mist, and liquid droplets of shale oil, and light hydrocarbon gases, such as methane, ethane, ethene, propane and propene, as well as other products, such as hydrogen, nitrogen, carbon dioxide, carbon monoxide, ammonia, steam, and hydrogen sulfide. A carbon residue typically remains on the retorted shale.

Shale oil is not a naturally-occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

Underground formations of oil shale contain various layers, deposits or strata of rich and lean oil shale. The relative richness, leanness, and depth of these layers typically vary throughout the underground formation and depend upon the particular location of the formation.

The process of pyrolyzing the kerogen in oil shale, known as retorting, to form liberated hydrocarbons, can be done in surface retorts in aboveground vessels or in in situ retorts under ground. In situ retorts require less mining and handling than surface retorts.

In in situ retorts, a flame front is continuously passed downward through a bed of rubblized oil shale to liberate shale oil, off gases, and residual water. There are two types of in situ retorts: true in situ retorts and modified in situ retorts. In true in situ retorts, all of the oil shale is retorted under ground as is, without mining or transporting any of the shale to aboveground locations. In modified in situ retorts, some of the oil shale is mined and conveyed to the surface to create a cavity or a void space in the retorting area. The remaining underground oil shale is then explosively rubblized to substantially fill the void space. The oil shale which has been conveyed to the surface is available for retorting above ground.

Typically, modified in situ retorts are formed explosively by sequentially blasting through the formation in a stepwise manner, either downwardly or upwardly. Upward blasting in conjunction with vertical crater retreat mining requires that explosives be lowered to various depths in bottomless (extremely deep) blast holes. The amount and location of the explosives are a function of the size of the retort to be formed, the relative richness and leanness of the shale to be blasted, the shape of the retort, and the desired particle size of the oil shale fragments.

Explosives can be lowered into a bottomless blast hole with a wire rope and then detonated without the use of a plug, but such technique is often inaccurate, fails to properly confine the downward thrust of the explosive forces, and causes numerous other problems. Plugs can be lowered and suspended in a blast hole with a line, but the placement of such plugs is inaccurate and unreliable for depths greater than 150 feet and is only temporary.

Prior art blast plugs, also referred to as "pigs," have been set in bottomless blast holes of oil and gas wells by laying a pipe to the desired depth in a blast hole and forcing a basket of mechanical fingers down the inside or outside of a pipe with a fluid, until the fingers come out the bottom of the pipe and expand. Thereafter, concrete is forced down the pipe with a fluid to contact and harden about the fingers.

Over the years various methods and devices for blasting in situ retorts and forming blasting bridges for oil wells have been suggested. Typifying these methods and devices are those found in U.S. Pat. Nos. 2,216,067; 3,762,771; 3,980,339; 4,043,595; 4,043,596; 4,043,597; 4,043,598; 4,146,272; 4,175,490; 4,192,553; 4,192,554; 4,201,419; 4,205,610; 4,210,366; 4,245,865; 4,262,965; 4,272,127; and Canadian Patent No. 1,012,564. Spent oil shale has also been used to manufacture cement for a variety of purposes. Typifying the various spent shale cement manufacturing methods and uses of spent shale cement are those found in U.S. Pat. Nos. 2,592,468; 2,904,445; 3,135,618; 3,459,003; 4,120,355; 4,131,416; 4,198,097 and 4,231,617. These prior art methods and devices have met with varying degrees of success.

It is therefore desirable to provide an improved apparatus for setting a plug in a bottomless blast hole.

SUMMARY OF THE INVENTION

An improved apparatus is provided for accurately installing and setting a generally permanent, composite concrete plug in a bottomless blast hole of in situ oil shale retort or an oil or gas well. The apparatus is particularly useful in connection with upwardly blasting an underground formation of oil shale in a stepwise progressive manner, such as by vertical crater retreat mining and blasting, in order to form a generally upright, modified in situ retort. Advantageously, the novel apparatus is effective, reliable, economical, efficient and relatively easy to use.

To this end, the novel plugging apparatus has an expandable bag containing a cementatious slurry of water and concrete or spent shale, with a mineral aggregate, such as gravel, sand, etc. The bag can be a flexible plastic bag, or a fabric or canvas bag, although it is preferred that the bag is formed of wrapped plastic tubing. A rigid impact resistant tube, such as an open-ended metal canister, is provided to contain the bag when the apparatus is lowered to the desired depth in a blast hole.

The bag is supported and carried by a bag support assembly, preferably in the form of a concrete disc with a drainpipe extending upwardly through and above the disc. Connected to the drainpipe are a plurality of tie lines including a first line for holding the bag in a retracted storage position within the canister, and a substantially longer second line for holding the bag generally below the canister in an expanded engagement position in which the bag of cementatious slurry expansively engages and hardens against the walls of the blast hole in order to form a stationary composite blasting plug across the blast hole. The composite blasting plug includes the hardened bag of cementatious slurry (concrete) and the bag support assembly (disc and drainpipe) to which the concrete is connected when the cementatious slurry hardens and sets.

Preferably, a cap covers the drainpipe when the bag is in its retracted storage position within the canister in order to prevent cementatious slurry from entering and clogging the drainpipe. A third tie line is preferably connected to the cap to effectively lift and uncover the cap from the drainpipe when the bag is dropped below the canister.

Desirably, an electrically powered sequencer is secured in fixed relationship to and above the canister to automatically and sequentially hold and release the tie lines. Advantageously, the sequencer is controlled and actuated remotely, is retrievable for repeated use, and can be used in hostile, underground environments. The sequencer has a rotatable indexing wheel with outwardly extending fingers to releasably hold the tie lines. An electrically conductive power cable is provided to lower, energize and raise the sequencer. In the illustrative form, a bail connects the canister to the legs of the sequencer.

As used throughout this application, the terms "retorted oil shale" and "retorted shale" refer to oil shale which has been retorted to liberate hydrocarbons leaving an organic material containing residual carbon.

The terms "spent oil shale" and "spent shale" as used herein mean retorted shale from which all of the residual carbon has been removed by combustion.

A more detailed explanation of the invention is provided in the following description and appended claims taken in conjunction with the accompanying drawings.

DETAILED DESCRIPTION OF THE PREFFERED EMBODIMENT

Figure 1:
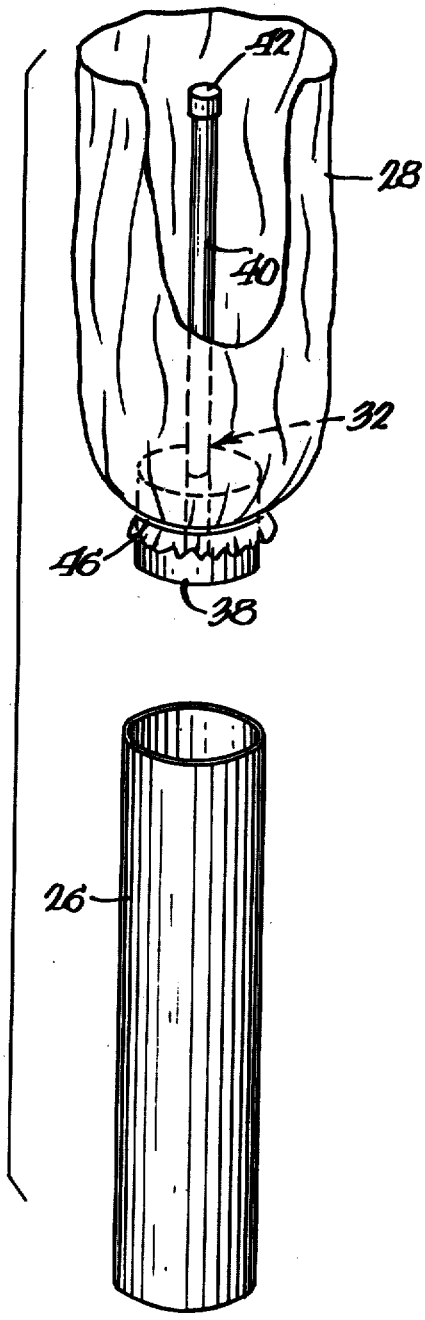
FIG. 1 is a perspective assembly view of parts of a plugging apparatus in accordance with principles of the present invention.

A plugging apparatus 20 (FIG. 2) is provided to plug a bottomless (very deep) blast hole 21 (FIGS. 3–5) in a subterranean formation 22 of oil shale. Apparatus 20 provides a device or system which is particularly useful for placing, forming, installing and setting a permanent, stationary, nonmovable, composite concrete plug 23 (FIG. 5) across the blast hole at a desired depth for use in conjunction with blasting, rubblizing and explosively forming a generally upright, modified in situ retort. While the apparatus and process of the present invention are described hereinafter with particular reference to subterranean formations of oil shale, it will be apparent that the apparatus and process can also be used in connection with plugging blast holes for oil and gas wells.

The plugging apparatus 20 (FIG. 2) has a steel power cable 24 with an insulated conductor connected to an electrically powered, automatic sequencer 25. Apparatus 20 also has an elongated tube such as an open-ended tubular canister 26 with an upwardly extending overhead bail 27 which is pivotally connected to and carried by the downwardly extending legs of the sequencer 25. In the plugging apparatus, a flexible, expandable bag 28 is provided to contain a cementatious slurry 30 of a freshly made quick set cement mixture. The bag of cementatious slurry is supported by a composite bag support assembly 32, which is detachably connected to the sequencer 25 through a plurality of tie lines or retaining lines 34 and 36.

The cementatious slurry can be made by mixing cement and a mineral aggregate, such as sand and/or gravel, with a sufficient quantity of water to cause the cement to set and and bind the entire slurry into a concrete plug when lowered to the desired depth in the blast hole. The cementatious slurry is preferably a quick set cement mixture, such as ASTM Type 3 utility cement. A pozzolanic material, such as spent oil shale or fly ash, can be added to the cement to enhance the handling characteristics and modify the setting characteristics of the cement. In order to improve retorting efficiency and recovery, and maximize the use of products produced during retorting, a particularly effective cementatious slurry can be formed by mixing water and spent oil shale obtained from an adjacent in situ retort or an aboveground retort. The cementatious slurry of spent oil shale and water can include other additives, such as lignosulfonate, sodium silicate and/or sodium gluconate.

The bag support assembly 32 supports the underside of the bag of cementatious or concrete slurry. The bag support assembly can be cast, fabricated, or molded in a variety of shapes and desirably includes a connection member or connector 40 to which the tie lines 34 and 36 are connected. In the preferred embodiment, the bag support assembly 32 has a cylindrical concrete disc 38 and an upright impact resistant, rigid plastic drainpipe 40 made of polyvinyl chloride tubing or the like. The concrete disc 38 is preferably cast of the same cementatious slurry as that contained in the bag 28 and has a maximum outside diameter or span slightly less than the inside diameter of the canister 26 so that the disc can be at least partially contained and enclosed within the canister when the plugging apparatus is lowered to the desired depth in the blast hole. While the above arrangement is preferred, it may be desirable in some circumstances to use a disc which has the same or slightly larger diameter than the canister so that the disc can be positioned flush against the bottom of the canister.

The drainpipe 40 extends above the disc 38 to provide a connector to which the tie lines 34 and 36 are connected as well as to provide a support and reinforcement for the concrete plug. The drainpipe also extends entirely vertically through the center of the disc to provide a drain hole and drainage passageway for drainage and passage of water through the otherwise water-impervious disc. Advantageously, the drainpipe 40 serves to prevent accumulation of rain water and underground aquifer water on top of the plug in the blast hole after the plug has been formed and hardened. Water accumulation above the disc degrades some types of explosives, makes blasting more difficult, and creates a pressure head which can move the disc downward out of position. For example, a blasting plug with a 700 foot depth would carry and accumulate a column of water having a pressure head of 300 psi, if drainage through the disc were not provided.

The disc 38 is preferably molded or cast out of concrete around the drainpipe so as to be integrally connected to the drainpipe. While a concrete disc and plastic drainpipe are most effective, other materials can be used for the disc and/or drainpipe, if desired, such as lead, cast iron, etc. Furthermore, other connectors can be used, such as rings, knobs, handles, grates, crossbars, rods, bails, etc.

Figure 2:
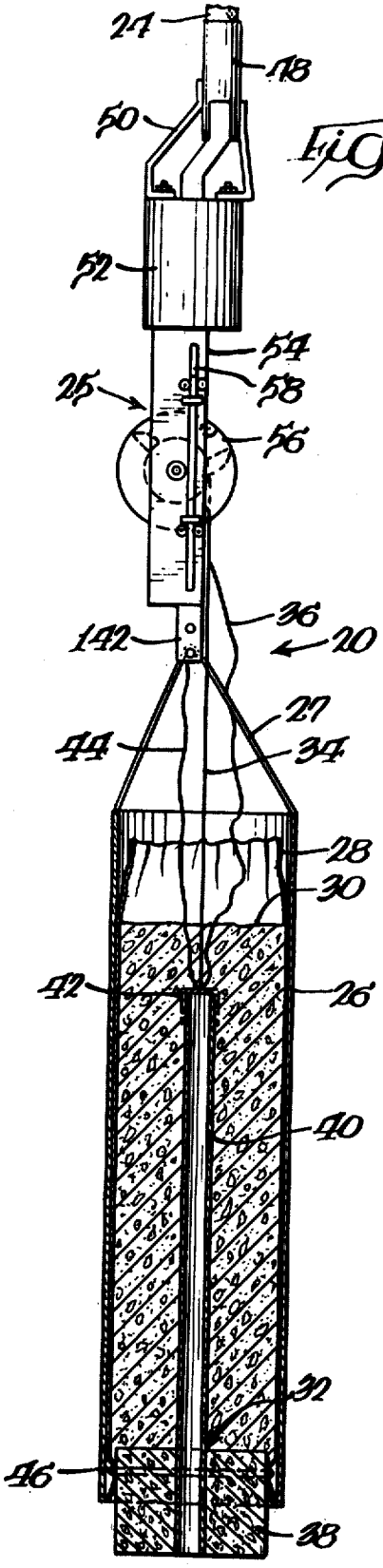
FIG. 2 is a side view of the plugging apparatus, shown partly in cross section, as it is lowered to the desired depth in a bottomless blast hole.
Figure 3:
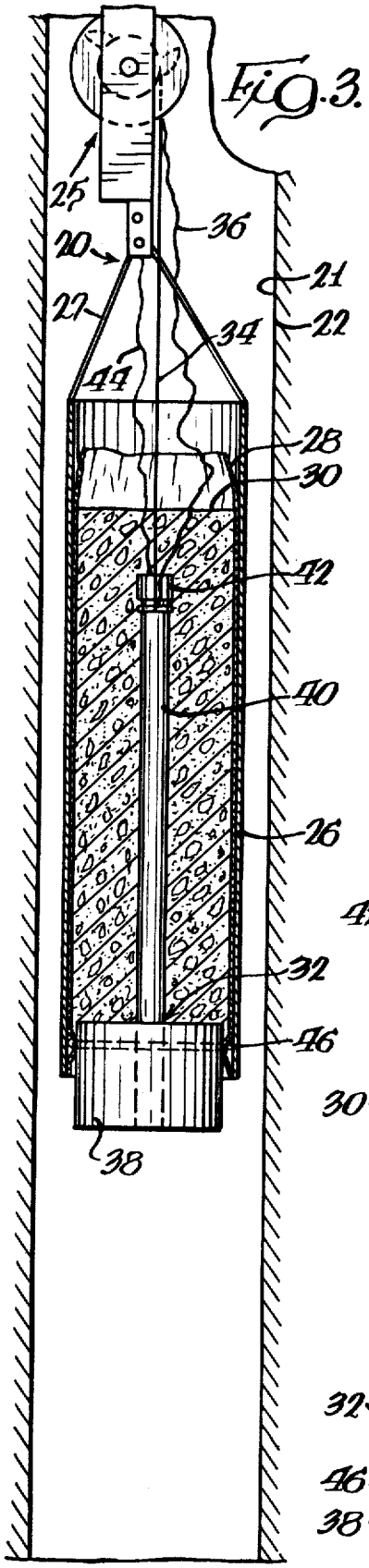
FIG. 3 is a fragmentary cross-sectional view of the plugging apparatus after it is lowered to the desired depth.
Figure 4:
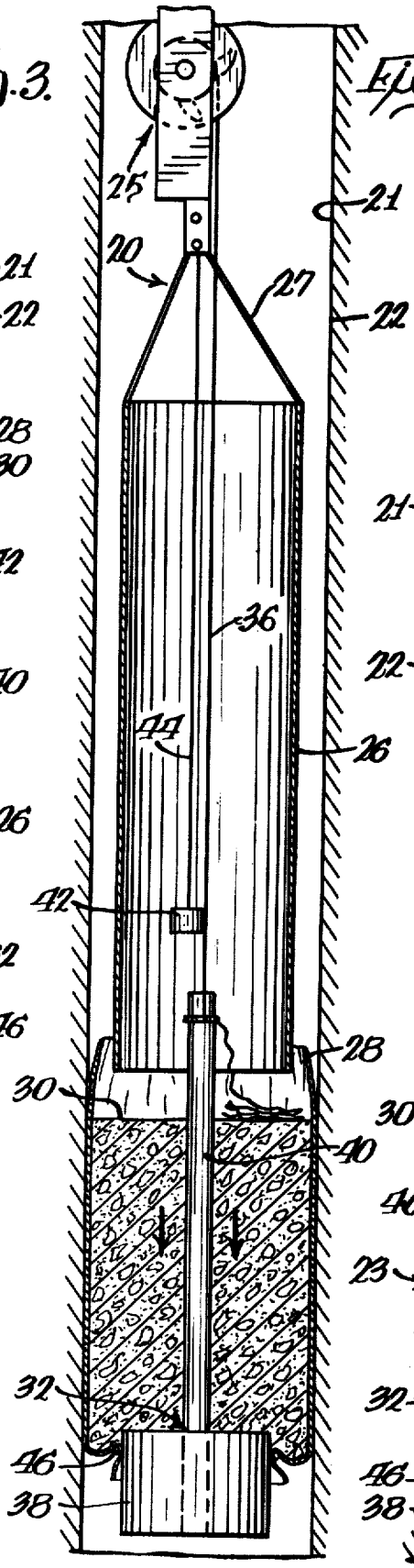
FIG. 4 is a fragmentary cross-sectional view of the plugging apparatus after the bag of concrete has been dropped below the canister.
Figure 5:
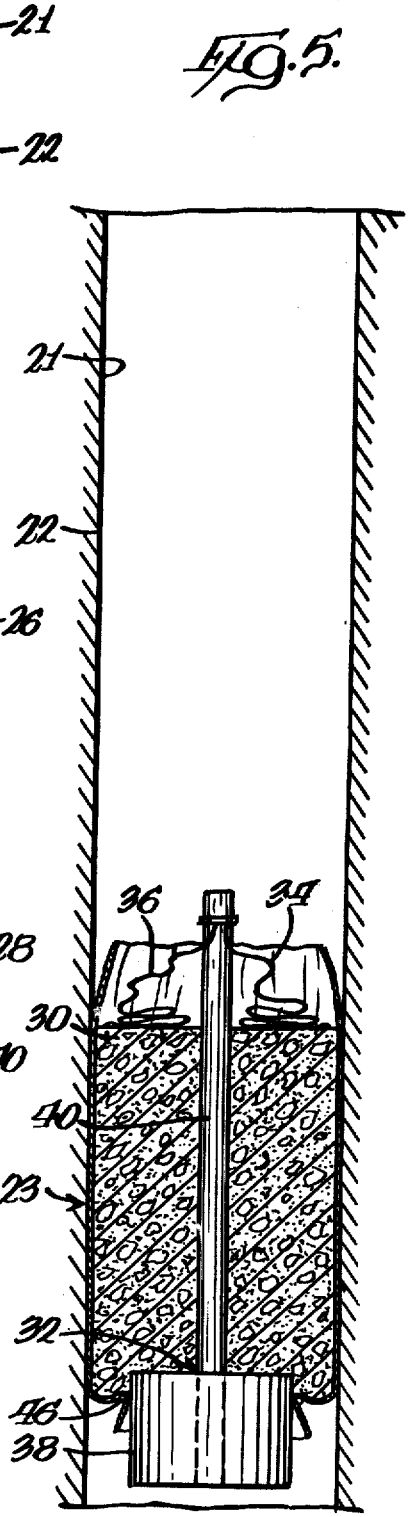
FIG. 5 is a cross-sectional view of the bag of concrete after it has hardened and set against the walls of the blast hole to form a concrete plug.

In the preferred embodiment, a plastic or aluminum cap 42 (FIG. 2) covers the top of the drainpipe 40 when the bag of cementatious slurry is housed within the canister 26 to prevent the cementatious slurry from entering and clogging the drainpipe. A tie line 44 connects the cap 42 to the downwardly extending legs of the sequencer 22. Tie line 44 is longer than line 34 but shorter than line 36. The tie line 44 is slack when line 34 is taut as shown in FIGS. 2 and 3, and is taut when line 36 is taut as shown in FIG. 4 to remove the cap 42 from the top of the drainpipe 40 when the bag and the top of the cementatious slurry have dropped below the canister 24 and the top of the drainpipe, respectively. Removal of the cap allows water to pass through the drainpipe of the plug.

The flexible bag 28 should be of sufficient size to expand against the walls of the blast holes when the bag is dropped or otherwise lowered beneath the canister 26 as shown in FIG. 4. The bottom of the bag is formed with, or punctured to have, an opening that fits around the drainpipe as well as the upright cylindrical outer wall of the disc 38. While the bag can be made of plastic, such as polyethylene or silicone rubber, or of a fabric, such as a waterproof canvas, the bag is preferably constructed by wrapping plastic film tubing around the drainpipe. The bag can be gathered and tied to the interface of the drainpipe and the disc or to the outer upright wall of the disc by a tie line or plastic clip 46 (FIGS. 1–5). The bag should have sufficient strength to support and contain the cementatious slurry when the bag is lowered within, as well as dropped below, the canister 26.

As shown in FIG. 1, the tubular canister 26 is elongated and open-ended. In the embodiment shown, the canister has a cylindrical shape and an outside diameter slightly smaller than the diameter of the blast hole. The canister is preferably made of aluminum, although impact resistant plastic or other metals can be used, if desired. In the illustrated embodiment, the canister has a pivotable bail 27 to securely hand the canister from the bottom legs of the sequencer 25. While a cylindrical canister is preferred for best results, it may be desirable in some circumstances to use a tubular canister with a square or polygonal-shaped cross section.

The sequencer 25 (FIG. 2) is secured to and positioned above the canister 26 by the bail 27 to automatically and sequentially hold and release the tie lines 34 and 36. The bottom end of the cable 24 (FIG. 2) has an externally threaded cap which is threadedly connected to an internally threaded tubular member 48 of the sequencer 25. The cable serves to lower, energize, and raise the sequencer. The cable is raised and lowered with a power winch (not shown) above ground.

Figures 6, 7, 8:
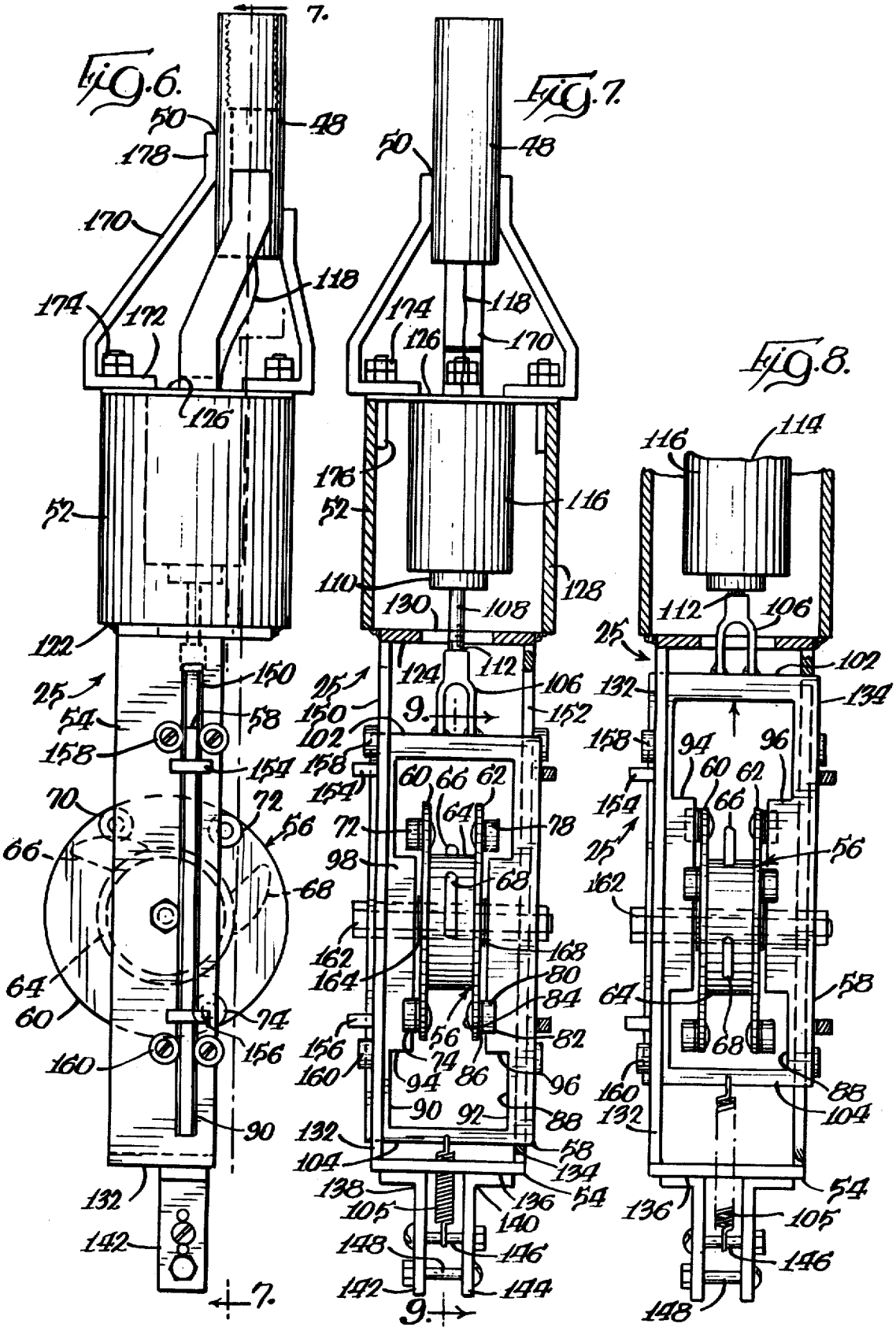
FIG. 6 is a side view of a sequencer for automatically and remotely carrying out the process in accordance with principles of the present invention.
FIG. 7 is a cross-sectional view of the sequencer taken substantially along line 7—7 of FIG. 6 and illustrating the movable frame and solenoid-actuated plunger in a downward released position.
FIG. 8 is a fragmentary cross-sectional view similar to FIG. 7, but illustrating the movable frame and the plunger in an upward position.

As best shown in FIGS. 2, 6, and 7, the sequencer 25 has an upwardly extending offset spider 50, a solenoid assembly 52, a stationary frame 54, a rotatable indexing wheel assembly 56, and a movable sequencing frame or slide plate 58. The sequencer is preferably made of noncorrosive metal, such as high tensile strength aluminum.

The indexing wheel 56 (FIGS. 6–12) of the sequencer 25 has a pair of annular flanges 60 and 62 (FIGS. 7 and 8) which provide sidewalls, and a cylindrical hub or retaining cylinder 64 which extends between and is welded or otherwise securely connected to the sidewalls. Hook-shaped fingers or pins 66 and 68 (FIGS. 9–11) extend arcuately, eccentrically and generally radially outwardly from the hub 64 to releaseably hold the tie lines 34 and 36. A series of abutment stops 70, 72, 74, 76, 78, and 80 (FIGS. 6–12) extend laterally outwardly from the sidewalls 60 and 62. Each stop includes an annular bearing or roller 82 (FIG. 7) rotatably mounted upon a shaft member, such as a bolt or pin 84, and slidably positioned against a washer 86.

As best shown in FIGS. 7 and 8, the movable sequencing frame 58 is fabricated to define a generally I-shaped opening 88 which receives the wheel assembly 56. The movable frame 58 surrounds the wheel assembly and has upright sides 90 and 92 with inwardly extending abutment flanges 94 and 96. The front and back surfaces 98 and 100, respectively, (FIGS. 9–11) abuttingly engage the stops 70, 72, 74, 76, 78, and 80 at various times as the wheel is indexed. A pair of generally horizontal members 102 and 104 (FIG. 7) extends between and integrally connects the sides 90 and 92 of the movable sequencing frame. The end members include a top 102 and bottom 104 positioned above and below the wheel 56, respectively. The middle portion of the bottom member 104 is drilled to provide an aperture which receives the upper hooked end of a compression spring 105.

An internally threaded bifurcated socket, turn-buckle or clevis 106 (FIG. 7) extends upwardly from and is welded to the top surface of top member 102. An upwardly extending reciprocating threaded rod 108 has its bottom end threadedly connected to the socket 106 and its top end threadedly connected to a piston 110. The rod cooperates with the socket and piston to provide an upwardly extending, reciprocating, solenoid actuated plunger 112. The socket permits adjustment of the slide plate relative to the rod. If desired, the socket can be an internally threaded cylinder rather than bifurcated.

A solenoid 116 releasably holds the plunger 112. The solenoid cooperates with the spring 105 to reciprocatingly drive the movable frame 58 from an upward grasping position, as shown in FIG. 8 when the solenoid is activated, to a downward released position, as shown in FIG. 7 when the solenoid is deactivated. An electrical wire 118 (FIG. 6) extends upwardly from the solenoid into the interior of the tubular member 48. The electrical wire 118 has a female electrical terminal 120 at its upper end which plugs into the cable.

The solenoid assembly 52 includes the solenoid 116 (FIG. 7) and a solenoid housing 122 which encloses, surrounds, and houses the solenoid. The housing 122 has an annular bottom plate 124, a circular top plate 126, and an upright cylindrical wall 128 which extends between and is welded or othewise securely connected to the top and bottom plates. The bottom plate 124 has a central hole 130 through which the plunger 112 can freely pass.

The stationary frame 54 extends downwardly from, and is securely welded or otherwise fixedly connected to, the bottom plate 124 of the solenoid housing 122. The stationary frame has a pair of vertical rectangular plates which provide elongated upright arms 132 and 134 (FIGS. 6–12). The upper ends of the arms are preferably welded to the bottom plate 124. A rectangular bottom plate 136, which is also referred to as a crossbar or bight, extends between and is welded to the bottom ends of arms 132 and 134. A pair of L-shaped angles 138 and 140 are welded to the underside of horizontal bottom plate 136. The L-shaped angles 138 and 140 provide downwardly extending legs 142 an 144, respectively. The legs 142 and 144 have a series of holes to receive bolts 146 and 148. Bolt 146 provides a transverse spring retainer which holds the bottom hooked end of the compression spring 105. The spring 105 urges, biases and pulls the slide plate to its downward position when the solenoid is deenergized. The bottom bolt 148 holds the bail 26 which extends upwardly from the canister, as well as holds the tie line 44 which extends upwardly from the drainpipe cap.

The upright arms 132 and 134 of the stationary frame 54 each have an upright elongated slot 150 and 152 which are aligned in registration with each other to slidably receive the vertical sides 90 and 92 of the movable frame (slide plate) 58. Extending laterally outwardly from each upright arm 132 and 134 of the stationary frame 54 are ears, U-shaped slot guards or guide members 154 and 156. Ears 154 and 156 are spaced laterally outwardly of and across the slots 150 and 152 to prevent the upright sides 90 and 92 of the movable frame 58 from sliding laterally outwardly past the ears.

Two pairs of roller bearings 158 and 160 (FIG. 7) extend laterally outwardly from each of the upright arms 132 and 134 of the stationary frame 54. Each pair of bearings is positioned on opposite sides of the elongated slots 150 and 152 to rotatably engage the upright sides 90 and 92 of the movable frame in the slots when the upright sides slide up and down in the slots.

A transverse shaft 162, which can be provided by a horizontal bolt, extends between the upright arms 132 and 134 of the stationary frame 54 to rotatably support the wheel 56. Washers 164 and 168 can be placed on the shaft 154 to prevent the wheel 56 from rubbing against the flanges 94 and 96 of the movable frame (slide plate) 58. Inwardly extending spacers which are welded to the inside of the upright arms of the stationary frame can be mounted about the shaft to serve as bearings for the shaft as well as to provide spacers to keep the wheel positioned between the flanges of the slide plate.

As best shown in FIG. 6, a spider 50 extends above the solenoid assembly 52. The spider 50 has an upright, internally threaded tubular member 48 which is held vertically in place by three or four offset mounting members or rigid metal straps 170. The bottom of the mounting members 170 has inwardly turned feet 172 which are mounted flush against the top of the cover plate 126 of the solenoid housing 122. Jamb nuts 174 and studs 176 securely mount the feet against the cover plate 126. In the illustrative embodiment the studs 176 (FIG. 7) are welded to the inner surface of the upright cylindrical wall 128 of the solenoid housing 122. Each of the mounting members 156 has an upwardly extending neck 178 which is welded to the tubular member 48 to fixedly position the tubular member in general vertical alignment and registration with the taut release lines 34 and 36 and the drainpipe. The mounting members also position the tubular member 48 in offset relationship with the plunger 112 as well as with the vertical center line of the solenoid 116 and the stationary and movable frames 54 and 58. The internally threaded tubular member 48 threadedly receives and is connected to an externally threaded cablehead or cap at the bottom end of the cable. An allen set screw with a plain cup point can be screwed into the tubular member 48 to held tighten and lock the cablehead, as desired.

In order to form an upright modified in situ retort, a generally horizontal mine or tunnel is excavated in a subterranean formation of oil shale at a depth which is to generally coincide with the bottom of the retort. A series of vertical blast holes are drilled into the subterranean formation of oil shale to communicate with the mine. The blast holes are plugged at depths selected by the blasting supervisor, with the plugging apparatus. Explosive charges are placed (set) on the concrete plug and detonated to explosively rubblize and blast the oil shale into the mine. A top cap or plug can be inserted in the blast hole above the charge, if desired, to contain the pressure of the explosion. The plugging and detonating procedure are then repeated at progressively higher levels in the blast hole until the entire retort is explosively formed and the oil shale contained therein rubblized. Intermediate tunnels or mines can also be used.

Figure 9:
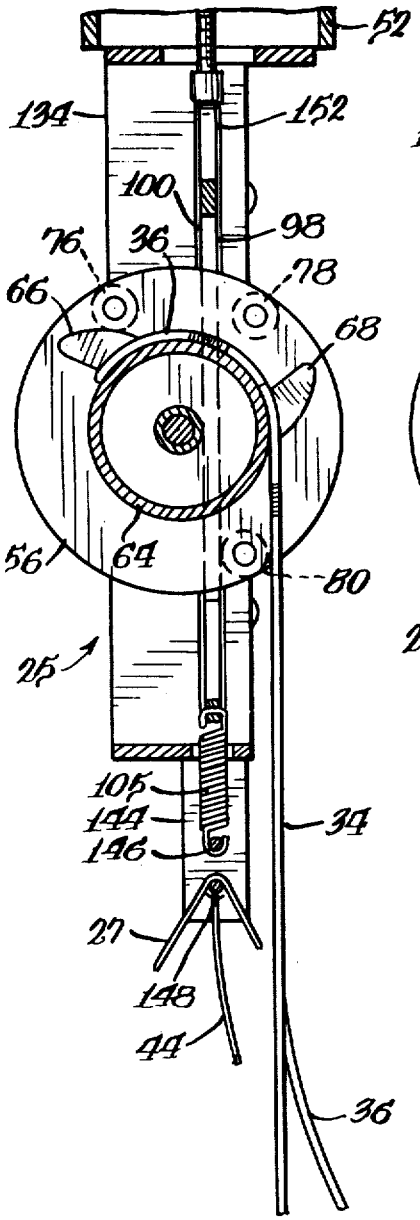
FIG. 9 is a fragmentary side view of the sequencer holding a pair of tie lines connected to the bag support assembly.

In use, the blasting apparatus 12 (FIG. 2) is assembled above ground by casting the concrete disc 38 about the drainpipe 40, covering the drainpipe with a cap 42, securing the tie lines 34, 36, and 38 to the drainpipe and cap, respectively, and tying the bag 28 to the bag support assembly 32. The sequencer 25 is connected to the cable 24, and the bail 27 of the canister 26, as well as the cap tie line 44, is hung from the sequencer. The bag 28 and support assembly 33 are then placed in the tubular canister 26 as shown in FIG. 2, and the cementatious slurry is carefully poured into the bag. In some circumstances it may be desirable to fill the bag with cementatious slurry before the bag is lowered into the canister, although generally it is preferred to fill the bag with cementatious slurry after the bag has been placed in the canister. The tie lines 34 and 36 are then releasably hung on or tied to the teeth 68 and 66, respectively, of the indexing wheel 56 as shown in FIG. 9.

In order to install the plug, the plugging apparatus 20 is lowered into the blast hole by the cable until the bottom of the canister 26 reaches the desired depth, as shown in FIG. 3. The cable can be lowered by an electric winch above ground, which has a digital counter or is otherwise calibrated to indicate to the operator the amount of cable paid out. In this manner the operator can know how much cable has been unwound and subsequently to what depth the plugging apparatus has been lowered. When the plugging apparatus is being lowered to the desired depth, the bag 28 of concrete is entirely contained within the canister 26 and the indexing wheel 56 of the sequencer is in the position shown in FIG. 9. After the plugging apparatus is lowered to the desired depth, the solenoid 116 is deactivated (deenergized) to release the plunger 112 and the movable frame (slide plate) 58 is pulled downward by compression spring 105 to its downward position as shown in FIG. 7. In the downward position (FIGS. 6, 7, and 9), stops 74 and 80 abut against and engage the front surfaces 98 of the abutment flanges 94 and 96 of the movable frame 58 to prevent the wheel from rotating clockwise, unwinding under the load of the concrete disc and bag of cementatious slurry, and releasing the tie lines 34 and 36 prematurely.

Figure 10:
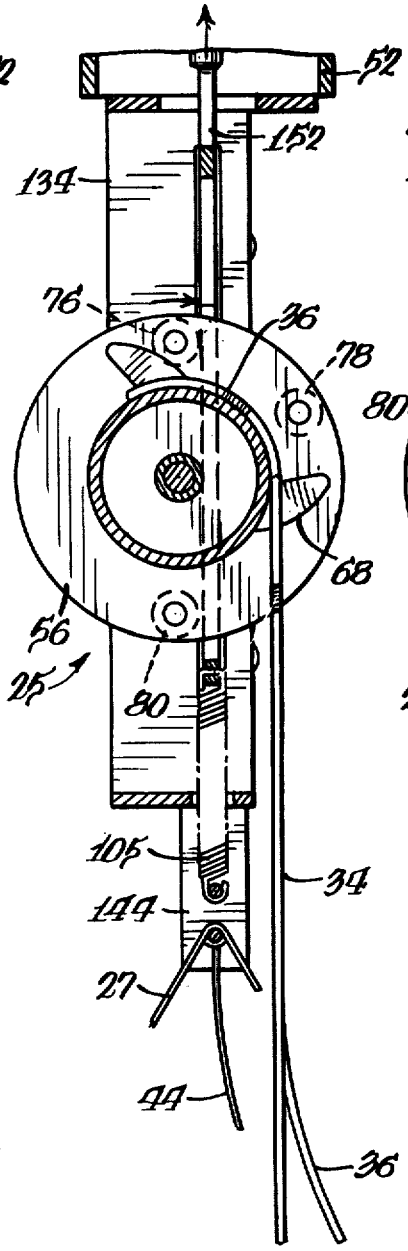
FIG. 10 is a fragmentary side view of the sequencer immediately prior to releasing the first line and before dropping the bag of concrete below the canister.
Figure 11:
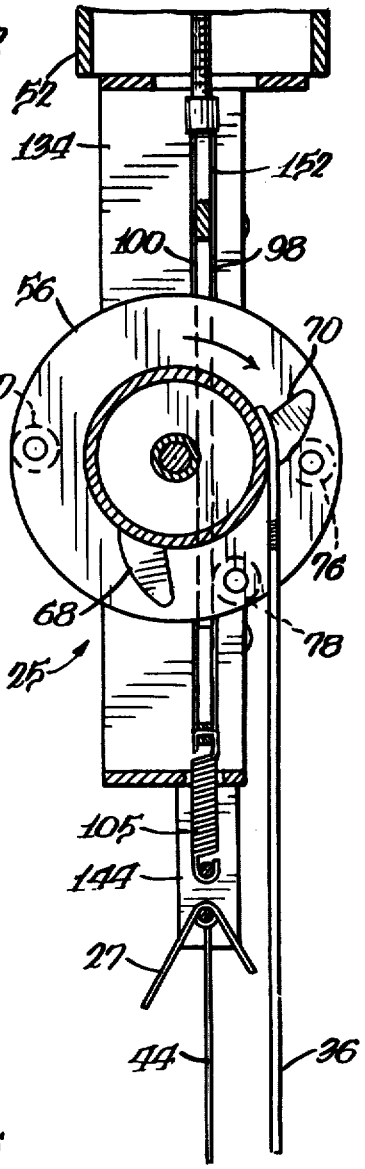
FIG. 11 is a fragmentary side view of the sequencer, immediately prior to releasing the second line after the bag of concrete has dropped below the canister and expanded and hardened against the walls of the blast hole to form the concrete plug.
Figure 12:
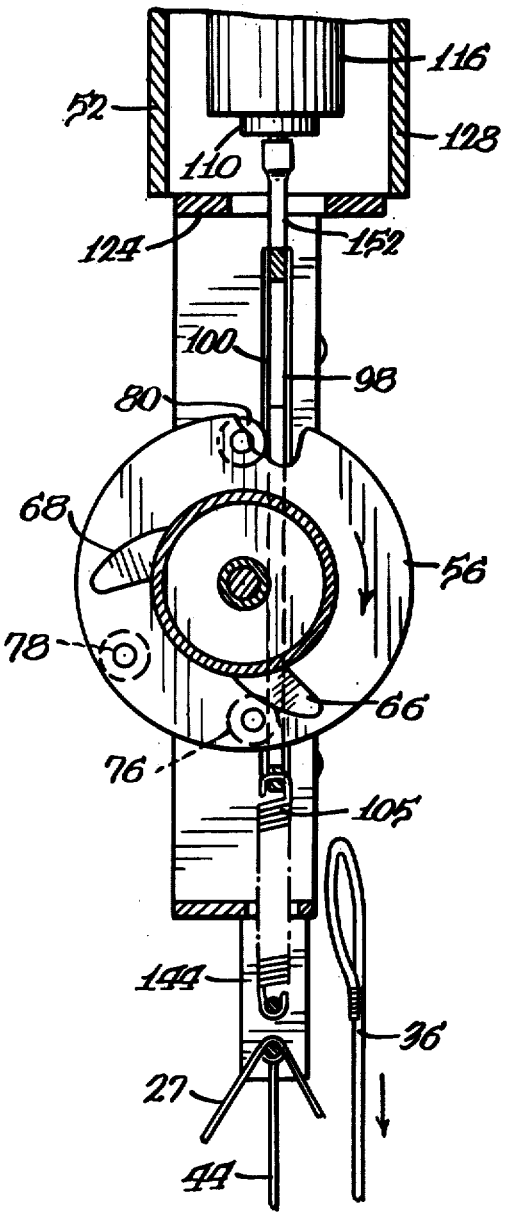
FIG. 12 is a fragmentary side view of the sequencer, after the second tie line has been released.
Figure 13:
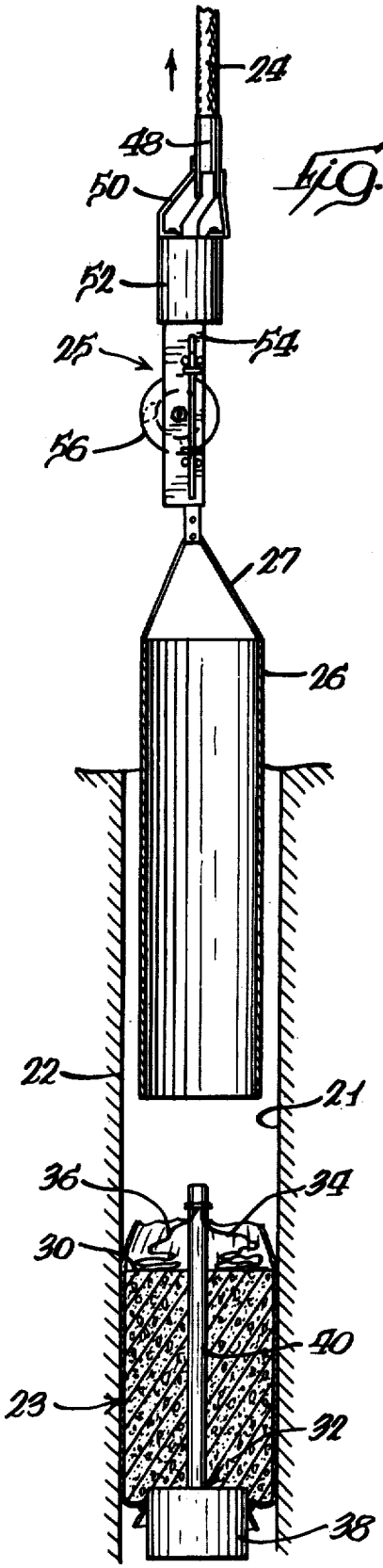
FIG. 13 is a perspective view of the plugging apparatus being withdrawn from the blast hole after the plug has been set.

After the plugging apparatus has been lowered to the desired depth, the operator throws (activates) a switch to transmit electrical impulses downward through the cable from a power source above ground to activate and energize the solenoid 116 to hold and pull the plunger 112 upwardly, overcoming the downward forces of the compression spring 105 as shown in FIG. 8. When the solenoid is activated to its upward grasping position, the movable frame (slide plate) 58 is pulled upwardly, which raises the abutment flanges 94 and 96 and removes the resistance to stops 74 and 80. In the upward position, wheel 56 freely rotates, indexes, unwinds, and arcuately advances in the clockwise direction under the load of the concrete disc and bag of cementatious slurry, until the stops 70 and 76 abut against and engage the back surfaces of the abutment flanges 94 and 96 of the movable frame (slide plate) 58 as shown in FIG. 10. If desired, the sequencer can be lowered to the desired depth in the blast hole while keeping the solenoid energized.

After the plugging apparatus has been lowered to the desired depth in the blast hole and the sequencer has been moved to the position shown in FIG. 10, the switch is closed by the operator to deactivate and deenergize the solenoid, which releases the plunger 112 and causes the movable frame 58 to be pulled downward by the compression spring 105. When the movable frame is pulled downward to its downward position, the abutment flanges 94 and 96 are lowered, removing the abutment and resistance to stops 70 and 76, which allows the indexing wheel 56 to rotate, index, unwind, and arcuately advance in the clockwise direction under the weight of the load of the concrete disc and bag of cementatious slurry, until the stops 72 and 78 abut against and engage the front surfaces 98 of the slide plate's abutment flanges 94 and 96. When the wheel 56 is advanced or indexed to the first releasing position shown in FIG. 11, tooth 68 moves to a downward position and releases the shorter tie line 34 under the weight of the load of the concrete disc and bag of cementatious slurry.

As shown in FIG. 4, when the tie line 34 is released, the bag of cementatious slurry and the disc 38 drop beneath the canister 26 until the tie line 36 becomes taut, causing the bag of concrete (cementatious slurry) to expand against, engage and conform to the walls of the blast hole. As the bag and disc are lowered below the canister, the level of cementatious slurry in the bag falls below the top of the drainpipe 40, and the cap 42 is removed from the top of the drainpipe to uncover the drainpipe because the cap line 44 is shorter than the elongated drainpipe line 36. The depth of distance to which the bag and disc fall below the canister 26 is determined by the length of the elongated drainpipe line 36. After the bag and disc have dropped below the canister, the cementatious slurry in the bag is allowed to dry, set, and harden against the walls of the blast hole to form a composite concrete plug substantially across the blast hole.

After the plug has been formed, the power switch is closed (activated) by the operator to energize the solenoid 116 to pull the plunger 112 to its upward position, overcoming the downward tug of the compression spring 105. When the plunger is pulled to its upward position, movable frame (slide plate) 58 and its abutment flanges 94 and 96 will be raised to effectively remove the abutment and resistance to stops 72 and 78, allowing wheel 56 to freely rotate, index, unwind, and arcuately advance in a clockwise position until stops 70 and 76 abut against and engage the back surfaces of the abutment flanges 94 and 96 of the movable frame 58. When this occurs, tooth 70 will arcuately advance and sequence to a downwardly facing position (FIG. 12), releasing tie line 36 in order to detach the hardened composite concrete plug from the plugging apparatus.

After the concrete plug has been separated from the plugging apparatus, the switch is turned off (opened) to deactivate the solenoid 116. The cable is then raised by the electric winch above ground, to remove the sequencer 25, the canister 26 and the cap 42 out of the blast hole before the explosive charge is set on the plug 18 and detonated. Alternatively, if desired, the sequencer and its attached canister and cap can be removed from the blast hole without deenergizing the solenoid.

The release of each stop is a positive event assuring reliable performance.

Although embodiments of the invention have been shown and described, it is to be understood that various modifications and substitutions, as well as rearrangements and combinations of parts and/or process steps, can be made by those skilled in the art without departing from the novel spirit and scope of this invention.

What is claimed is:

1. An apparatus for use in plugging a blast hole, comprising:

a cementatious slurry comprising spent oil shale;

expandable bag means for containing said cementatious slurry of spent oil shale, said bag means being movable from a retracted storage position to an expanded engagement position;

tube means for containing said bag means in said retracted position;

bag support means for supporting said bag means;

a first line connected to said bag support means for holding said bag means in said retracted storage position;

a second line substantially longer than said first line and connected to said bag support means for holding said bag means generally below said tube means in said expanded engagement position to permit said bag means containing said cementatious slurry of spent oil shale to engage and harden against the walls of said blast hole;

sequencer means including a vertically positioned rotatable indexing wheel located above said tube means, said vertically positioned rotatable indexing wheel having outwardly extending fingers for sequentially holding and releasing said first and second lines; and electrically conductive cable means for lowering, raising, and energizing said sequencer means in said blast hole.

2. An apparatus in accordance with claim 1 wherein said bag support means includes a concrete disc positioned against the bottom of said bag means, said concrete disc defining at least one drainage passageway extending entirely through said bag support means.

3. An apparatus in accordance with claim 1 wherein said bag means is selected from the group consisting of a flexible plastic bag, canvas bag, fabric bag and a wrapped plastic tubing bag.

4. An apparatus in accordance with claim 2 wherein said bag support means includes an upwardly extending drainpipe defining said drainage passageway.

5. An apparatus in accordance with claim 1 wherein said bag support means includes line connection means to which said lines are connected.

6. An apparatus in accordance with claim 1 wherein said bag support means cooperates with said bag means to form a plug substantially across the walls of said blast hole.

7. An apparatus for plugging a blast hole, comprising:

a cementatious slurry;

expandable plastic bag means for containing said cementatious slurry, said bag means being movable from a retracted storage position to an expanded engagement position;

bag support means for supporting said expandable plastic bag means, said bag support means including a concrete disc and a plastic drainpipe extending upwardly through and above said disc;

a tubular canister for containing said bag means in said retracted position;

a first line securely tied to said drainpipe for holding said bag means in said retracted storage position;

a second line substantially longer than said first line and securely tied to said drainpipe for holding said bag means generally below said canister in said expanded engagement position to permit said bag means to expansively engage, and said cementatious slurry to generally conform to and set against, the walls of said blast hole;

sequencer means for automatically sequentially holding and releasing said first and second lines, said sequencer means including rotatable indexing wheel means having a pair of annular flanges defining sidewalls, a hub extending between and connecting said sidewalls, a plurality of abutment stops extending laterally outwardly from said sidewalls, and a plurality of fingers extending generally radially and arcuately outwardly from said hub releasably holding a plurality of lines carrying a bag of cementatious slurry;

a movable sequencing frame providing a slide plate defining a generally I-shaped opening for receiving said wheel means, said movable sequencing frame having upright sides with inwardly extending abutment flanges for abuttingly engaging said stops, and a pair of generally horizontal end members extending between and connecting said sides including a top above said wheel means having an upwardly extending reciprocating plunger and a bottom below said wheel means defining a spring-receiving aperture, and said abutment flanges having a front surface and a back surface;

solenoid means for releasably holding said plunger;

electrical cable means for activating said solenoid means from a grasping position holding said plunger to a release position for releasing said plunger;

a stationary frame secured to and extending downwardly from said solenoid means, said stationary frame having a pair of elongated upright arms defining elongated upright slots for slidably receiving said sides of said movable frame, shaft means extending between said arms for rotatably supporting said wheel means, a pair of legs extending below said movable frame, and a spring retainer extending between and connecting said legs;

spring means for biasing and moving said movable frame to a downward position, said spring means having one end attached to said spring retainer of said stationary frame and another end insertable in said spring-receiving aperture and attached to said movable frame;

a spider having an internally threaded tubular member and a plurality of mounting members secured to and extending above said solenoid means for fixedly positioning said internally threaded tubular member in general vertical alignment with said lines and positioned in offset relationship with said plunger;

said movable frame being movable from an upward position when said solenoid means is holding said plunger in said grasping position, to said downward position by said spring means in response to said plunger being released by said solenoid means in said released position; and said wheel means arcuately advancing under the weight of said bag of cementatious slurry and said concrete disc when said movable frame is in said upward position until at least one of said stops engages the front surface of said abutment flanges and when said movable frame is in said downward position until at least one of said stops engages the back surface of said abutment flanges;

bail means connecting said canister to and below said legs; and electrically conductive cable means connected to said internally threaded tubular member for lowering, raising and energizing said sequencer means.

8. An apparatus in accordance with claim 7 wherein said concrete disc and plastic drainpipe are integrally connected to and cooperate with said cementatious slurry contained in said plastic bag means to form a composite plug substantially across the walls of said blast hole when said plastic bag means is in said expanded engagement position and said cementatious slurry has set.

9. An apparatus in accordance with claim 8 including cap means for covering said drainpipe when said plastic bag means is in said retracted storage position, and a third line for connecting said cap means to said sequencer means.

10. An apparatus in accordance with claim 7 wherein said bag means includes wrapped plastic tubing.

11. An apparatus in accordance with claim 7 wherein said cementatious slurry includes cement, water and a mineral aggregate selected from the group consisting essentially of sand and gravel.

12. An apparatus in accordance with claim 10 wherein said cementatious slurry includes a pozzolanic material selected from the group consisting essentially of spent oil shale and fly ash and said cement is ASTM Type 3 cement.

13. An apparatus in accordance with claim 7 wherein said cementatious slurry includes spent oil shale and water.

14. An apparatus in accordance with claim 7 including tie means for securely tying said plastic bag means to said disc.

15. An apparatus in accordance with claim 7 including tie means for securely tying said plastic bag means to said drainpipe.

16. An apparatus in accordance with claim 7 wherein said stops of said sequencer means each include an annular bearing rotatably mounted upon a shaft member.

17. An apparatus in accordance with claim 16 wherein said fingers of said sequencer means are generally hook-shaped and extend eccentrically outwardly from said hub.

18. An apparatus in accordance with claim 17 wherein said plunger includes a threaded rod having a lower end threadedly connected to an internally threaded socket and an upper end threadedly connected to a piston.

* * * * *

UNITED STATES PATENT OFFICE
CERTIFICATE OF CORRECTION

Patent No. 4,464,994 Dated August 14, 1984

Inventor(s) D. D. Porter

It is certified that error appears in the above-identified patent and that said Letters Patent are hereby corrected as shown below:

| Patent Column | Line | |
|---|---|---|
| 3 | 30 | After "prevent" add -- the -- |
| 6 | 36 | reads "hand" and should read --hang-- |
| 7 | 62 | reads "an" and should read --and-- |
| 8 | 57 | reads "held" and should read --help-- |

Signed and Sealed this

*Sixth* Day of *August 1985*

[SEAL]

*Attest:*

DONALD J. QUIGG

*Attesting Officer* *Acting Commissioner of Patents and Trademarks*